US006237774B1

(12) United States Patent
Stageberg

(10) Patent No.: US 6,237,774 B1
(45) Date of Patent: May 29, 2001

(54) PACKAGE FOR STACKED ELEMENTS WITH MEANS FOR SEPARATION

(76) Inventor: Wilfred E. Stageberg, 2215 Falcon Ave., St. Paul, MN (US) 55119

( * ) Notice: Subject to any disclaimer, the term of this patent is extended or adjusted under 35 U.S.C. 154(b) by 0 days.

(21) Appl. No.: 09/638,622

(22) Filed: Aug. 15, 2000

(51) Int. Cl.[7] ..... B65D 85/62
(52) U.S. Cl. ..... 206/499; 206/460
(58) Field of Search ..... 206/499, 460, 206/813; 53/447; 209/45, 48; 210/266, 282, 287, 493.5, 497.01

(56) References Cited

U.S. PATENT DOCUMENTS 2,112,959 * 4/1938 Harvey ..... 206/499
4,362,623 * 12/1982 Holopainen ..... 206/499
5,741,535 * 4/1998 Cope et al. ..... 206/499
5,884,763 * 3/1999 Ozawa ..... 206/813
5,924,563 * 7/1999 Salyers ..... 206/499
6,116,418 * 9/2000 Sadow ..... 206/460

* cited by examiner

*Primary Examiner*—Luan K. Bui
(74) *Attorney, Agent, or Firm*—William L. Huebsch

(57) ABSTRACT

A method and combination for separating a singular element from a stack of contiguous similar stacked elements intended for individual use. A container for the stack is provided that has a layer of pressure sensitive adhesive firmly attached along one of its surfaces. To separate an individual element the stack is removed from the container, an outer or end element in the stack is pressed against the layer of adhesive, and the stack is pulled away from the layer of adhesive to separate at least a portion of the outer filter from the adjacent filter in the stack. The separated element is then peeled away from the layer of adhesive.

7 Claims, 1 Drawing Sheet

PACKAGE FOR STACKED ELEMENTS WITH MEANS FOR SEPARATION

FIELD OF THE INVENTION

The present invention relates to a stack of contiguous elements (e.g., filter elements) in a container that are intended for individual use outside of the container, which elements have sufficient engagement with adjacent elements in the stack to normally maintain the integrity of the stack when it is handled.

BACKGROUND OF THE INVENTION

Known in the prior art are stacks of contiguous filter elements in a container that are intended for individual use outside of the container (e.g., the coffee and tea filters sold by "BUNN" (registered trade mark)). Those filter elements have sufficient engagement with adjacent filter elements in the stack to normally maintain the integrity of the stack when it is handled. Difficulties arise when a user removes the stack of filter elements from the container and attempts to remove a single filter element from the stack. The outer edges of the filter elements are closely disposed, very flexible, and of somewhat fragile consistency so that it is difficult for the user to separate a single filter element from the other filter elements in the stack. A user will typically pick at the edge of the stack with his or her fingernails, and if that causes separation of filter elements in the stack it will often cause separation of two or three filter elements that then have to be separated from each other in a separate operation. This difficulty in separating a single filter element can be frustrating and can reflect negatively on use of the filter elements.

DISCLOSURE OF THE INVENTION

The present invention facilitates separation of a single element from a stack of elements, such as separation of a single filter element of the type described above.

The present invention provides the combination of a container, a stack within the container of contiguous stacked elements intended for individual use outside of the container, which elements have sufficient engagement with adjacent elements in the stack to normally maintain the integrity of the stack when it is handled; and a layer of pressure sensitive adhesive firmly attached along a surface of the container. The adhesive is adapted to adhere sufficiently to an outer or end element in the stack to separate at least a portion of that end element from the adjacent element in the stack when that end element is pressed against the layer of adhesive and the stack of elements is then moved away from the adhesive; and the adhesive is adapted so that the separated element can then be easily peeled from the layer of adhesive.

The layer of pressure sensitive adhesive can be attached along any of the surfaces of the container that is positioned to facilitate pressing the stack of elements against it, such as one of the outer surfaces of the container, or an inner surface of a cover for the container.

A release liner can be removably adhered over the surface of the layer of pressure sensitive adhesive opposite the container to restrict contact with the adhesive when it is not being used to separate an element from the stack.

The present invention has been found to be particularly useful in separating a single filter element from a generally cup shaped stack of similar porous filter elements formed of non woven fibers in which the shape of the stack and the fibers of adjacent filter elements provide sufficient engagement between adjacent filter elements in the stack to normally maintain the integrity of the stack when it is handled (e.g., the coffee and tea filter elements sold by "BUNN" (registered trade mark)).

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
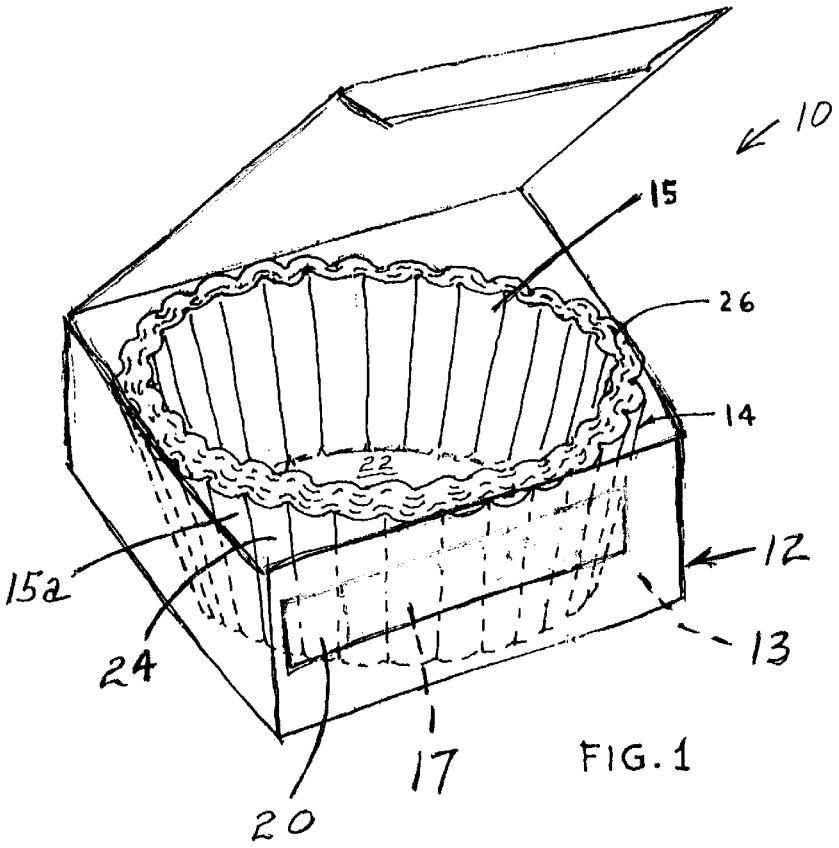
FIG. 1 is a fragmentary perspective view of the combination according to the present invention.
Figure 2:
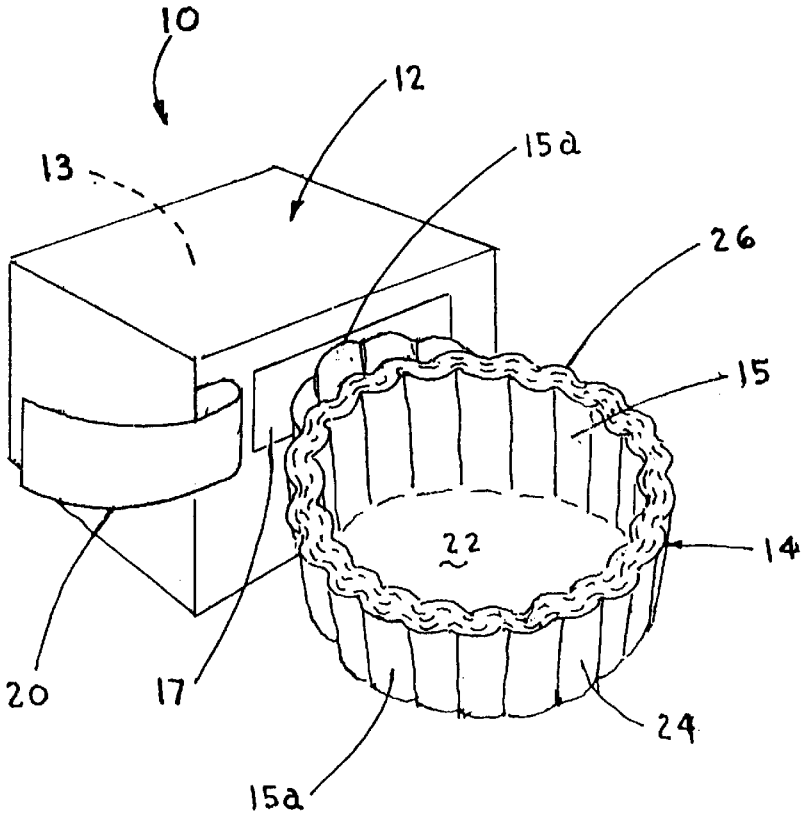
FIG. 2 is a perspective view of the an element being separated from a stack of elements included in the combination according to the present invention by a method including pressing the element against a strip of adhesive on a container included in the combination.

Referring now to FIG. 1 of the drawing, there is illustrated a combination according to the present invention generally designated by the reference numeral 10. Generally, that combination comprises a container 12 having walls that define a cavity 13; a stack 14 of contiguous similar stacked elements 15 intended for individual use outside of the container 12 which stack 14 is normally housed in the cavity 13; and a layer 17 of pressure sensitive adhesive firmly attached along a surface of the container 12. The elements 15 have sufficient engagement with adjacent elements 15 in the stack 14 to normally maintain the integrity of the stack 14 when it is handled. The adhesive in the layer 17 is adapted to adhere sufficiently to an end or outer one 15*a* of the elements 15 in the stack to separate at least a portion of that end element 15*a* from the adjacent element in the stack 14 when that end element 15*a* is pressed against the layer 17 of adhesive and the stack 14 of elements 15 is then moved away from the layer 17 of adhesive (see FIG. 2). The adhesive in the layer 17 is adapted to then afford separation of the separated element 15*a* from the layer 17 of adhesive.

The walls of the container 12 can be of any suitable material such as a stiff or flexible fibrous or polymeric material.

The layer 17 of adhesive can be of any adhesive material that will adhere sufficiently to the end element 15*a* in the stack to separate at least a portion of it from the adjacent element in the stack 14 when that end element 15*a* is pressed against the layer 17 of adhesive and the stack 14 of elements 15 is then moved away from the layer 17 of adhesive (see FIG. 2), and then affords separation of the separated element 15*a* from the layer 17 of adhesive. The adhesive in No. 950 Adhesive-Transfer tape commercially available from Minnesota Mining and Manufacturing Company, St. Paul, Minn., has been found suitable as is described below, however, other transfer adhesives, a double adhesive coated tape or other pressure sensitive material could also be suitable.

The layer 17 of pressure sensitive adhesive can be attached along any of the surfaces of the container 12 that facilitate pressing the stack 14 of elements 15 against it, such as an outer surface of one of the side walls of the container 12 as illustrated. An optional release liner 20 (e.g., a silicone coated liner 20) can optionally have one end attached to the container (e.g., by being mechanically attached as by a staple or by being trapped in a seam in the container 12) and can be removably adhered over the surface of the layer 17 of pressure sensitive adhesive opposite the container 12 to restrict contact with the layer 17 of adhesive when it is not being used to separate an element 15*a*. Such a liner 20 is particularly useful when the layer 17 of adhesive is on an outer surface of the container 12.

As an example, the combination described above has been found useful when, as illustrated, the stack of elements is the stack 14 of 50 generally cup-shaped coffee and tea filter elements 15 sold by "BUNN" (registered trade mark)). Those filter elements 15 are porous and formed of non woven fibers, with the cup-like shape of the stack 14 and engaged fibers of adjacent filter elements 15 providing sufficient engagement of adjacent filter elements 15 in the stack 14 to normally maintain the integrity of the stack 14 when it is handled. The circular filter elements 15 in the stack 14 apparently have been die cut from a stack of sheets of filter material and pressed into the cup-like shape with smooth circular central portions 22 and diverging pleated or fluted frusto conical side wall portions 24 projecting around their central portions 22. The peripheral edges of the filter elements 15 that define a lip 26 of the cup like shaped stack 14 are very closely adjacent so that the outer filter element 15*a* can be difficult to separate from the next filter element 15 in the stack 14. That stack 14 of filter elements 15 is typically sold in a pasteboard box or container 12. A length of the adhesive in No. 950 Adhesive-Transfer tape commercially available from Minnesota Mining and Manufacturing Company, St. Paul, Minn., was applied to the outer surface of a side wall of that container 12 to form the layer 17 of adhesive. To separate the outer filter element 15*a* from the rest of the stack 14 a person removes the stack 14 from the container 12, lightly touches a part of the outer surface of the outer filter element 15*a* adjacent the lip 26 of the stack 14 against the layer 17 of adhesive, and then gently pulls the stack 14 away from the layer 17 of adhesive to separate a portion of that outer filter element 15*a* from the adjacent filter element 15 in the stack 14. That partially separated filter element 15*a* can then be manually engaged along its inner surface by the users index finger to complete its separation from the stack 14, while (or after which) the outer filter element 15*a* is peeled away from the layer 17 of adhesive.

The present invention has now been described with reference to one embodiment thereof It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

What is claimed is:

1. In combination:

a stack of contiguous stacked elements intended for individual use, said elements having sufficient engagement with adjacent elements in the stack to normally maintain the integrity of the stack when the stack is handled;

a container having walls with surfaces including outer surfaces and including inner surfaces defining a cavity adapted to removably receive said stack of elements; and a layer of pressure sensitive adhesive firmly attached along one of said surfaces of said container, said adhesive being adapted to adhere sufficiently to an end one of said elements in said stack to separate at least a portion of said end one of said elements from the adjacent element in the stack when said end one of the elements in the stack is pressed against the layer of adhesive and the stack of elements is then moved away from the adhesive, said adhesive being adapted to afford separation of the end one of the elements from the layer of adhesive.

2. A combination according to claim 1 wherein said layer of pressure sensitive adhesive is attached along one of said outer surfaces of said container.

3. A combination according to claim 2 further including a release liner removably adhered over a surface of said layer of pressure sensitive adhesive opposite said surface of the container to which said layer of pressure sensitive adhesive is attached.

4. A combination according to claim 1 further including a release liner removably adhered over a surface of said layer of pressure sensitive adhesive opposite said surface of the container to which said layer of pressure sensitive adhesive is attached.

5. A combination according to claim 1 wherein said stack has a generally cup-like shape and said elements are porous and formed of non woven fibers, the shape of the stack and the fibers of adjacent elements providing said sufficient engagement with adjacent elements in the stack to normally maintain the integrity of the stack when it is handled.

6. A combination according to claim 5 wherein said similar stacked elements are porous filter elements and comprise diverging pleated portions.

7. A method for separating a singular element from a stack of contiguous stacked elements intended for individual use, said method comprising the steps of:

providing the combination of a container for the stack and a layer of pressure sensitive adhesive firmly attached along a surface of the container;

removing the stack from the container;

touching the outer surface of an outer element in the stack against the layer of adhesive;

pulling the stack away from the layer of adhesive to separate at least a portion of the outer element from the adjacent element in the stack; and peeling the separated element from the layer of adhesive.

* * * * *